US008511761B2

(12) United States Patent
Numanoglu

(10) Patent No.: US 8,511,761 B2
(45) Date of Patent: Aug. 20, 2013

(54) HOUSEHOLD APPLIANCE COMPRISING A SLIDING DECORATIVE PANEL ON ITS DOOR

(75) Inventor: Guvenc Numanoglu, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 60 days.

(21) Appl. No.: 13/143,044

(22) PCT Filed: Dec. 15, 2009

(86) PCT No.: PCT/EP2009/067227
§ 371 (c)(1),
(2), (4) Date: Jun. 30, 2011

(87) PCT Pub. No.: WO2010/076200
PCT Pub. Date: Jul. 8, 2010

(65) Prior Publication Data

US 2011/0266932 A1 Nov. 3, 2011

(30) Foreign Application Priority Data

Dec. 30, 2008 (TR) ..... a 2008 10027

(51) Int. Cl.
*A47B 96/04* (2006.01)

(52) U.S. Cl.
USPC ..... 312/204

(58) Field of Classification Search
USPC ..... 312/326, 327, 204, 265.5, 265.6, 312/311, 109, 348.1, 348.4
See application file for complete search history.

(56) References Cited

U.S. PATENT DOCUMENTS

| | | | | |
|---|---|---|---|---|
| 7,770,985 | B2 * | 8/2010 | Davis et al. | 312/204 |
| 2003/0067254 | A1 * | 4/2003 | Manke et al. | 312/204 |
| 2004/0201337 | A1 * | 10/2004 | Wuestefeld et al. | 312/311 |

FOREIGN PATENT DOCUMENTS

| | | | |
|---|---|---|---|
| DE | 3026637 | A1 | 2/1982 |
| DE | 10161658 | A1 | 6/2003 |
| EP | 0744152 | A1 | 11/1996 |
| EP | 1529482 | A1 | 5/2005 |
| EP | 1894509 | A1 | 3/2008 |

* cited by examiner

*Primary Examiner* — Darnell Jayne
*Assistant Examiner* — Matthew Ing
(74) *Attorney, Agent, or Firm* — Venable, Campillo, Logan & Meaney PC

(57) ABSTRACT

A household appliance (1) comprising a body (2) which is disposed into the furniture, a door (3) which allows access into the body (2) and moves by rotating around a horizontal axis and which is opened by holding a handle, a hinge (4) which connects the door (3) to the body (2), and a decorative panel (5) which is slidably mounted onto the door (3).

20 Claims, 4 Drawing Sheets

HOUSEHOLD APPLIANCE COMPRISING A SLIDING DECORATIVE PANEL ON ITS DOOR

The present invention relates to a household appliance comprising a door which is opened by bending towards the front and a decorative panel which is assembled onto the door.

Figure 1:
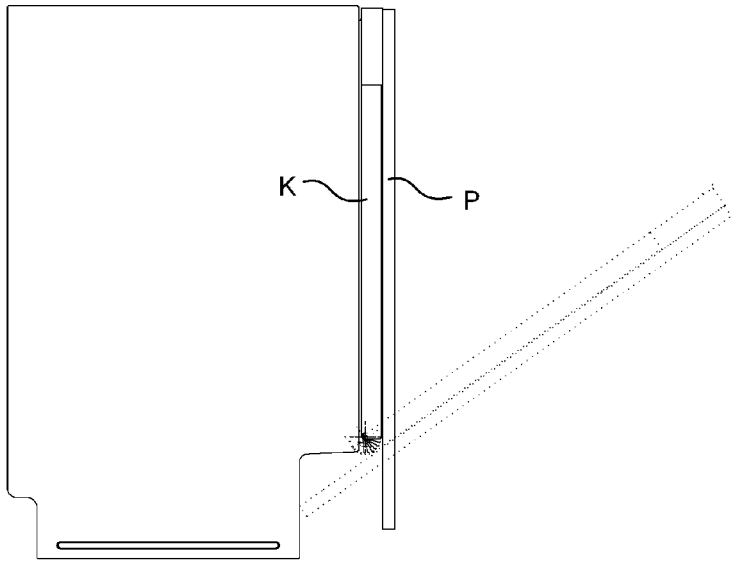
Figure 1 PRIOR ART

In household appliances such as dishwasher and oven, particularly in built-in products, a decorative panel is mounted onto the outer surface of the door and the door is opened by being rotated around the horizontal axis when the panel is mounted on the door. Since the household appliance is embedded in furniture, the panel and the door are required to be inserted under the furniture as being almost at the same level, when the door is closed. While the door (K) is opened by rotating, the panel (P) gets stuck at the lower side of the body and therefore, prevents the door (K) from opening since the length of the panel (P) is kept greater than the length of the body due to visual concerns (FIG. 1). In order to solve this problem, a means, which provides the panel and the door to move by pushing each other or the body while the door is opened and thus which enables the door to open 90 degrees, is mounted generally between the panel and the door. However, the detaching of the panel from the door while the door is opened causes various objections. Therefore, in the technique, sliding means, which provide the panel to be mounted onto the door such that it will slide on the door while the door is opened, are present.

In the state of the art German Patent Document No DE3026637, a dishwasher having a cladding which is fastened to two link arms, mounted onto the door, such that it will stand separately from the door and which falls down by its own weight until it bears against the lower portion of the body while the door is opened, is described.

A panel, which is slidably mounted to the door mentioned in the state of the art European Patent Document No EP1529482, slides beginning from the surface wherein it contacts the lower portion of the body towards the outside of the door by pushing a spring located between the door and the panel as it compresses the surface, while the door is opened.

The aim of the present invention is the realization of a household appliance wherein the panel, mounted on the door, does not prevent the opening of the door while the door is opened.

The household appliance realized in order to attain the aim of the present invention is explicated in the first claim and the other elements in the related claims.

The household appliance comprises a body, a door which is opened by bending, a hinge which provides the door to be fastened to the body from its lower edge, a panel which is mounted onto the door for decorative purposes, at least one channel which is located on the door in the vertical direction, and at least one pin which is located on the panel and which provides the panel to move slidably on the door by being mounted into the channel.

The household appliance comprises a balancing means which provides the panel to stand at the same level with the door by the effect of its weight when the door is closed, which slides the panel on the door as the effect of the panel weight decreases while the door is opened and which has a spring located on the door.

The balancing means is positioned preferably to the lower portion of the channel.

In an embodiment of the present invention, a stopper is mounted to the end of the pin. The stopper is mounted to the channel through an orifice located at the end of the channel.

In an embodiment of the present invention, the pin comprises a recess-shaped housing on its side surface. The pin is slipped to the door by the housing by partially entering the channel.

In an embodiment of the present invention, the balancing means comprises a leg which is mounted to the spring, a gear wheel which is mounted to the leg, a worm gear which provides the up and down movement of the gear wheel, and a casing which is mounted onto the door and which provides the leg, the gear wheel and the worm gear to be grouped. Thus, by adjusting the spring tension, the balancing means enables panels with different weights to be mounted to the door.

In an embodiment of the present invention, the household appliance comprises channels which are located at all four sides of the door, and balancing means which are disposed to all channels or to the two channels above. Accordingly, four pins are mounted onto the panel such that they will correspond to the channels.

In the household appliance of the present invention, when the door is closed, the weight of the panel overcomes the force of the spring and thus, keeps the spring compressed. As the door is opened, the effect of the panel weight on the spring changes and the spring slides the panel on the door by loosening.

The household appliance realized in order to attain the aim of the present invention is illustrated in the attached figures, where:

FIG. 1—is the schematic view of a household appliance in the prior art.

Figure 2:
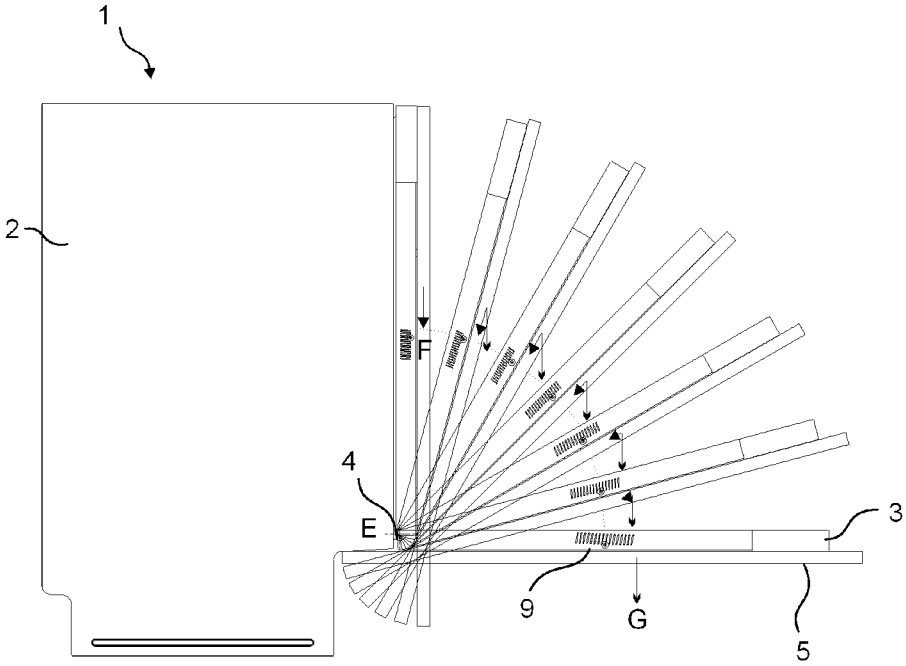

FIG. 2—is the sideways schematic view of a household appliance while its door is opened.

Figure 3:
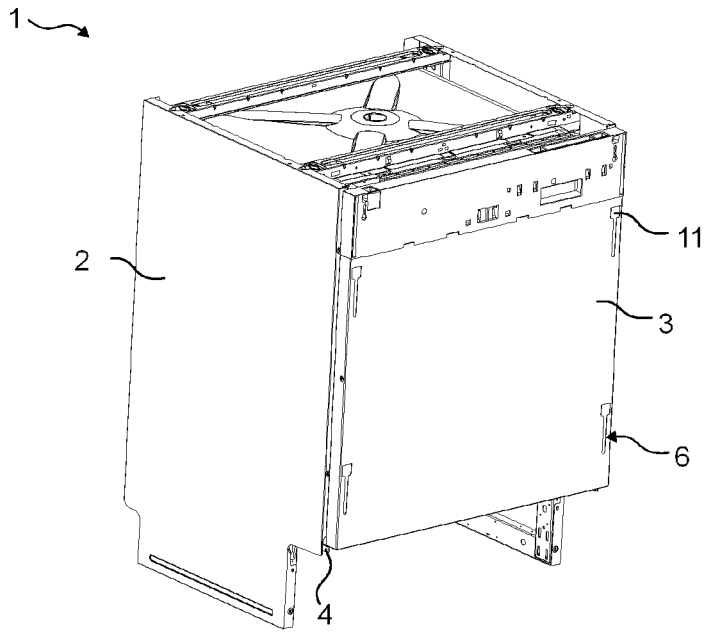

FIG. 3—is the perspective view of a household appliance.

Figure 4:
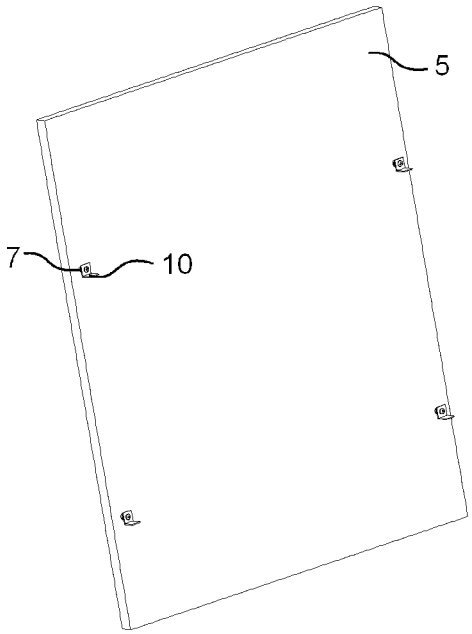

FIG. 4—is the schematic view of a pin and of a panel having a stopper in an embodiment of the present invention.

Figure 5:
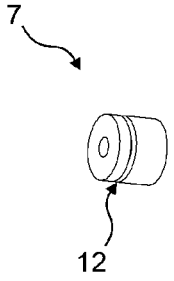

FIG. 5—is the perspective view of a pin in an embodiment of the present invention.

Figure 6:
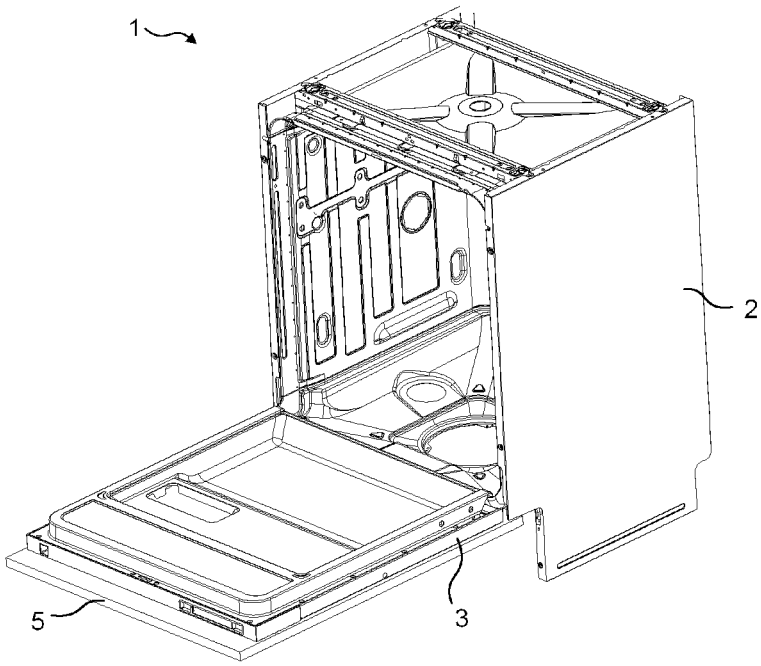

FIG. 6—is the perspective view of a household appliance when its door is open.

Figure 7:
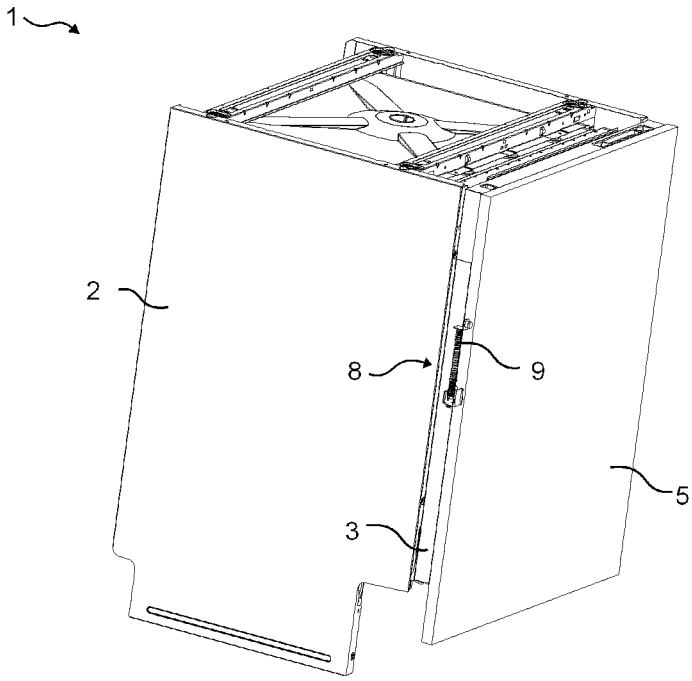

FIG. 7—is the perspective view of the household appliance when its door is closed.

Figure 8:
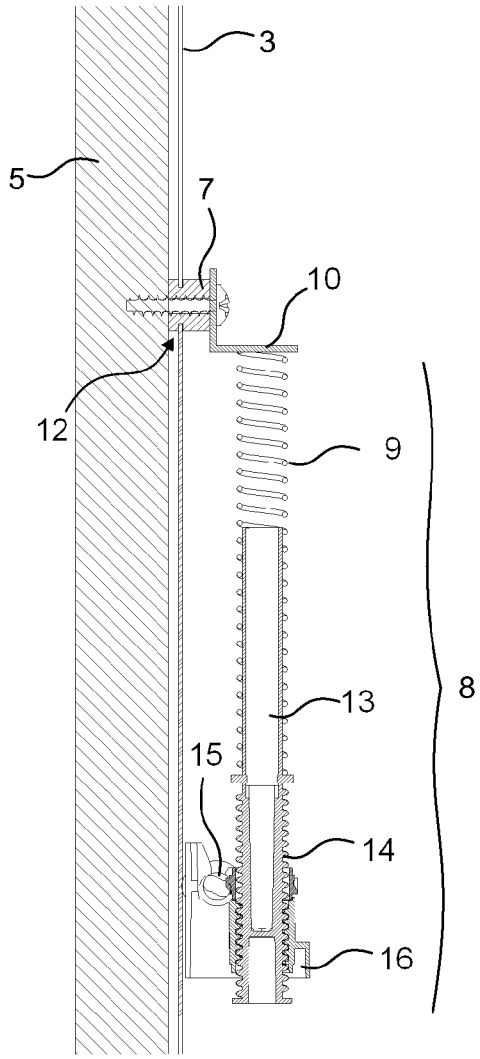

FIG. 8—is the cross-sectional view of a balancing means grouped on the door in an embodiment of the present invention.

Figure 9:
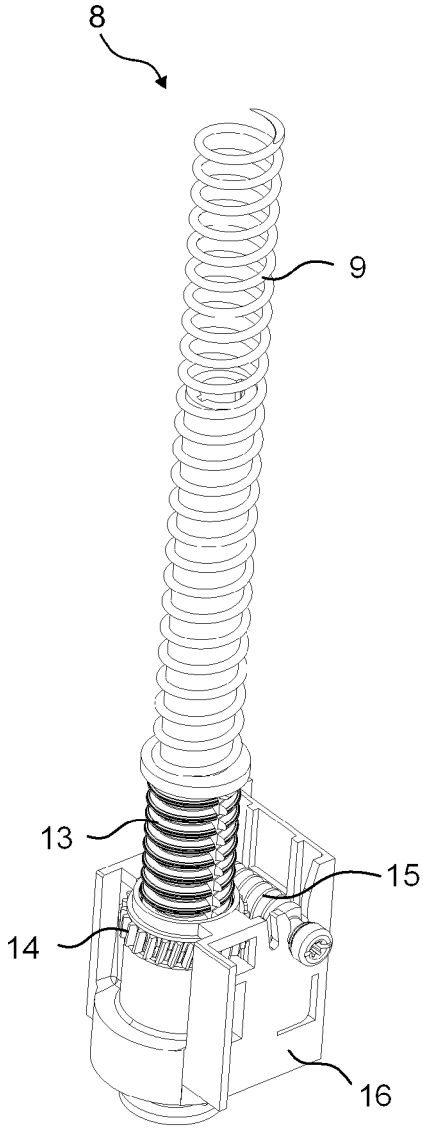

FIG. 9—is the perspective view of the balancing means in an embodiment of the present invention.

The elements illustrated in the figures are numbered as follows:

1. Household appliance
2. Body
3. Door
4. Hinge
5. Panel
6. Channel
7. Pin
8. Balancing means
9. Spring
10. Stopper
11. Orifice
12. Housing
13. Leg
14. Gear wheel
15. Worm gear
16. Casing The household appliance (1) comprises a body (2) which is disposed into the furniture, a door (3) which allows access into the body (2) and moves by rotating around a horizontal axis, a hinge (4) which connects the door (3) to the body (2), and a decorative panel (5) which is slidably mounted onto the door (3).

The household appliance (1), furthermore, comprises at least one channel (6) which is located on the door (3) in the vertical direction, and at least one pin (7) which is located on the panel (5) and which provides the panel (5) to move slidably on the door (3) by being mounted into the channel (6).

The household appliance (1) comprises a balancing means (8) which has a spring (9) which is located on the door (3) and against which the pin (7) bears, that, when the door (3) is closed, provides the panel (5) to stand at the same level with the door (3) by being compressed as a result of the component of the force (F) applied by the pin (7) by the effect of the panel (5) weight (G) and that, while the door (3) is opened, provides the panel (5) to slide on the door (3) by pushing the pin (7) since the component of the force (F) applied by the pin (7) decreases as a result of the weight (G) of the panel (5).

Since the door (3) is articulately connected to the hinge (4) from its lower edge, it can be opened without contacting the body (2). The panel (5) is longer than the door (3) and is mounted to the door (3) such that its lower edge will overflow towards the outside of the lower edge of the door (3) and its upper edge will be at the same level with the upper edge of the door (3) when the door (3) is closed. This position of the panel (5) on the door (3) is realized by adjusting the tension of the spring (9) under the pin (7) according to the weight (G) of the panel (5) by means of the balancing means (8). While the whole weight (G) of the panel (5) is exerted onto the spring (9) in the vertical direction as a resultant force (F) by the pin (7) when the door (3) is closed, the component of the force, occurring as a result of the panel (5) weight (G), in the compressing direction of the spring (9) decreases gradually while the door (3) is opened. Thus, while the spring (9) is loosened gradually, it slides the panel (5) on the door (3) by pushing the panel (5). Thus, while the panel (5) covers the whole front surface of the body (2) when the door (3) is closed, it enables the door (3) to be fully opened by diverging from the lower portion of the body (2) while the door (3) is opened (FIG. 2, FIG. 3, FIG. 6 and FIG. 7).

The balancing means (8) is positioned preferably onto the inner surface of the door (3), under at least one of the channels (6).

In an embodiment of the present invention, the household appliance (1) comprises a plate-shaped stopper (10) which is mounted to the end of the pin (7) and against which the spring (9) bears, and an orifice (11) which is located at the upper portion of the channel (6) and through which the stopper (10) is mounted into the channel (6) by means of the pin (7). When the panel (5) will be mounted to the door (3), the stopper (10) is passed through the orifice (11), the pin (7) is slid downwards by being slipped in the channel (6) and the stopper (10) is seated onto the spring (9). Thus, since the stopper (10) is wider than the channel (6), the panel (5) is provided to slide on the door (3) without being detached from the door (3) while the pin (7) moves up and down in the channel (6) (FIG. 3 and FIG. 4).

In an embodiment of the present invention, the pin (7) comprises a housing (12) which is located at its side surface and wherein the edge of the channel (6) is slipped. Thus, the pin (7) can move in the channel (6) in a balancing manner without being detached from the channel (6), and the distance of the stopper (10) is preserved such that it will not contact the door (3) (FIG. 5 and FIG. 8).

In an embodiment of the present invention, the balancing means (8) comprises a leg (13) which is mounted to the spring (9) end that does not contact the stopper (10), a gear wheel (14) which is mounted to the leg (13), a worm gear (15) which provides the gear wheel (14) to compress the spring (9) or to loosen it, and a casing (16) which is mounted onto the door (3) and whereon the leg (13), the gear wheel (14) and the worm gear (15) are mounted and thus, by adjusting the spring (9) tension, it enables panels (5) with different weights to be mounted to the door (3) (FIG. 8 and FIG. 9).

The leg (13), which is preferably cylindrical, provides the spring (9) to be mounted onto the gear wheel (14) by being partially inserted into the spring (9). During the production or maintenance, panels (5) with different weights and/or different sizes are aligned with the door (3) by means of adjusting the cylindrical gear wheel (14), which is mounted into the casing (16) such that it will stand vertically, by rotating the worm gear (15), which is horizontally positioned into the casing (16). Thus, the tension of the spring (9) is adjusted and hence, the upper edge of the panel (5) and the upper edge of the door (3) are at the same level.

In an embodiment of the present invention, the household appliance (1) comprises one channel (6) each, which is on the door (3) on each of its four corners, and a balancing means (8) which is disposed in all channels (6) or in some of them (FIG. 3 and FIG. 4). There are four pins (7) on the door (3). One balancing means (8) each are disposed preferably under the two channels (6) above.

By means of the balancing means (8) of the present invention, the panel (5) does not prevent the opening of the door (3) by sliding on the door (3) towards the outside of the rotational axis of the door (3) while the door (3) is opened, and meanwhile, the panel (5) does not contact the body (2). Furthermore, by means of the present invention, while the panel (5) is mounted to the door (3), the balancing means (8) is adjusted according to the weight (G) of the panel (5) and thus, household appliances (1) having different panels (5) can be produced by using the same door (3) and the same balancing means (8).

It is to be understood that the present invention is not limited to the embodiments disclosed above and an expert in the technique can easily introduce different embodiments. These should be considered within the scope of the protection postulated by the claims of the present invention.

The invention claimed is:

1. A household appliance (1) comprising a body (2) which is disposed into a furniture, a door (3) which allows access into the body (2) and moves by rotating around a horizontal axis, a hinge (4) which connects the door (3) to the body (2), and a decorative panel (5) which is slidably mounted onto the door (3), characterized by at least one channel (6) which is located on the door (3) in a vertical direction, at least one pin (7) which is located on a panel (5) and which allows the panel (5) to move slidably on the door (3) by being mounted into a channel (6), and a balancing means (8) which has a spring (9), which is located on the door (3) and against which the pin (7) bears, that, when the door (3) is closed, allows the panel (4) to stand at the same level with the door (3) by being compressed as a result of the component of a force (F) applied by the pin (7) by an effect of a weight (G) of the panel (5) and that, while the door (3) is opened, allows the panel (5) to slide on the door (3) by pushing the pin (7) since the component of the force (F) applied by the pin (7) decreases as a result of the panel (5) weight (G) of the panel (5).

2. The household appliance (1) as in claim 1, further comprising a plate-shaped stopper (10) which is mounted to an end of the pin (7) and against which the spring (9) bears.

3. The household appliance (1) as in claim 2, wherein the pin (7) comprises a side surface at which a housing (12) is located and wherein the edge of the channel (6) is slipped.

4. The household appliance as in claim 2, further comprising a plurality of channels, each channel of said plurality of channels being located on one of four corners of the door, and wherein the balancing means is disposed in one or more of the channels.

5. The household appliance (1) as in claim 2, further comprising an orifice (11) which is located at an upper portion of the channel (6) and through which the stopper (10) is mounted into the at least one channel (6) by means of the pin (7).

6. The household appliance as in claim 5, further comprising a plurality of channels, each channel of said plurality of channels being located on one of four corners of the door, and wherein the balancing means is disposed in one or more of the channels.

7. The household appliance (1) as in claim 5, wherein the pin (7) comprises a side surface at which a housing (12) is located and wherein the edge of the channel (6) is slipped.

8. The household appliance as in claim 7, further comprising a plurality of channels, each channel of said plurality of channels being located on one of four corners of the door, and wherein the balancing means is disposed in one or more of the channels.

9. The household appliance (1) as in claim 2, wherein the balancing means (8) comprises a leg (13) which is mounted to the spring (9) end that does not contact the stopper (10),—a gear wheel (14) which is mounted to the leg (13), a worm gear (15) which allows the gear wheel (14) to compress the spring (9) or to loosen it, and a casing (16) whereon the leg (13), the gear wheel (14) and the worm gear (15) are mounted, and wherein, by adjusting the spring (9) tension, the balancing means enables panels (5) with different weights to be mounted to the door (3).

10. The household appliance as in claim 9, further comprising a plurality of channels, each channel of said plurality of channels being located on one of four corners of the door, and wherein the balancing means is disposed in one or more of the channels.

11. The household appliance (1) as in claim 1, wherein the balancing means (8) is positioned onto an inner surface of the door (3), under at least one channel (6).

12. The household appliance (1) as in claim 11, wherein the pin (7) comprises a side surface at which a housing (12) is located and wherein the edge of the channel (6) is slipped.

13. The household appliance as in claim 11, further comprising a plurality of channels, each channel of said plurality of channels being located on one of four corners of the door, and wherein the balancing means is disposed in one or more of the channels.

14. The household appliance (1) as in claim 11, further comprising a plate-shaped stopper (10) which is mounted to an end of the pin (7) and against which the spring (9) bears.

15. The household appliance (1) as in claim 14, further comprising an orifice (11) which is located at an upper portion of the channel (6) and through which the stopper (10) is mounted into the at least one channel (6) by means of the pin (7).

16. The household appliance (1) as in claim 15, wherein the pin (7) comprises a side surface at which a housing (12) is located and wherein the edge of the channel (6) is slipped.

17. The household appliance (1) as in claim 14, wherein the balancing means (8) comprises a leg (13) which is mounted to the spring (9) end that does not contact the stopper (10),—a gear wheel (14) which is mounted to the leg (13), a worm gear (15) which allows the gear wheel (14) to compress the spring (9) or to loosen it, and a casing (16) whereon the leg (13), the gear wheel (14) and the worm gear (15) are mounted, and wherein, by adjusting the spring (9) tension, the balancing means enables panels (5) with different weights to be mounted to the door (3).

18. The household appliance (1) as in claim 14, wherein the pin (7) comprises a side surface at which a housing (12) is located and wherein the edge of the channel (6) is slipped.

19. The household appliance (1) as in claim 1, wherein the pin (7) comprises a side surface at which a housing (12) is located and wherein the edge of the channel (6) is slipped.

20. The household appliance (1) as in claim 1, further comprising a plurality of channels, each channel of said plurality of channels being located on one of four corners of the door (3), and wherein the balancing means (8) is disposed in one or more of the channels (6).

* * * * *